US005890386A

United States Patent [19]

Davi

[11] Patent Number: 5,890,386

[45] Date of Patent: Apr. 6, 1999

[54] PROCESS AND PLATE ROLL BENDING MACHINE

[75] Inventor: Orazio Maria Davi, Cesena, Italy

[73] Assignee: Promau S.R.L., Cesena, Italy

[21] Appl. No.: 982,645

[22] Filed: Dec. 2, 1997

[30] Foreign Application Priority Data

Dec. 18, 1996 [IT] Italy ..... MI96A2649

[51] Int. Cl.[6] ..... B21D 5/14

[52] U.S. Cl. ..... 72/13.4; 72/168; 72/173

[58] Field of Search ..... 72/167, 168, 170, 72/173–175, 13.4, 14.5

[56] References Cited

U.S. PATENT DOCUMENTS

| | | | |
|---|---|---|---|
| 160,647 | 3/1875 | Chapman . | |
| 518,765 | 4/1894 | Plecker | 72/175 |
| 4,312,208 | 1/1982 | Schafer . | |
| 4,628,721 | 12/1986 | Williamson | 72/175 |
| 5,218,850 | 6/1993 | Davi . | |

FOREIGN PATENT DOCUMENTS

| | | | |
|---|---|---|---|
| 0 477 751 | 4/1992 | European Pat. Off. . | |
| 1025370 | 1/1955 | Germany | 72/170 |
| 10 25 370 | 3/1958 | Germany . | |
| 23 15 604 | 3/1975 | Germany . | |
| 24 43 195 | 3/1975 | Germany . | |
| 35 19 382 | 7/1995 | Germany . | |
| 195 33 618 | 3/1997 | Germany . | |
| 274318 | 11/1990 | Japan | 72/175 |
| WO 85/05297 | 12/1985 | WIPO . | |

*Primary Examiner*—Daniel C. Crane
*Attorney, Agent, or Firm*—Young & Thompson

[57] ABSTRACT

A process and a roll bending machine for bending plates. The plate to be bent is made to pass between upper and lower gripping rolls parallely arranged between each other; at least one of these rolls is connected to a drive motor for rotation. One of the rolls is upwardly movable to exert a required working pressure on the plate, and it is adjustably urged against the other roll in at least one intermediate position of its length till causing a deflection of both the rolls in the same direction, making one roll to assume an arch shaped configuration substantially conforming to the configuration of the other roll, in such a way to generate an homogenous bending pressure for the entire width of the plate which is thus bent with a substantially constant bending degree.

16 Claims, 4 Drawing Sheets

PROCESS AND PLATE ROLL BENDING MACHINE

BACKGROUND OF THE INVENTION

The present invention refers to a process and to a roll bending machine for bending plates and iron sheets, according to which the plate to be bent is made to pass between an upper and a lower gripping rolls which are parallely arranged between each other; at least one of these rolls is driven by a suitable drive motor to rotate, and in which at least one of the rolls is upwardly movably supported to exert the required working pressure on a plate to be bent.

The present invention may be advantageously applied to any type of roll bending machine, more simply indicated also as "bending machine", independently from the dimensions of the machine, which may be of two or three roll type depending on the specific use requirements.

Roll bending machine of this type are widely known and described in several prior patents, U.S. Pat. No. 160,647, U.S. Pat. No. 4,312,208 and U.S. Pat. No. 5,218,850 or EP 0 477 751.

The main function of a bending machine is to deform a plate by the pressure exerted by the working rolls, in particular by the upper gripping roll and by the lower gripping roll, which press the same causing an initial bending; a subsequent rotational movement of the rolls draws the plate deforming the same in a cylindrical or partially cylindrical form, for its entire width.

All the plate bending machines presently in use, have a common fundamental drawback relating to the incorrect closing of the edges of the bent plate, caused by the deflection of the rolls; in order to overcome this inconvenience, which moreover is of difficult solution, some extremely complex and expensive solutions have been proposed, in any case it is difficult to meet working requirements.

In fact, the rolls of a bending machine are generally supported and urged at their ends; the strong pressure exerted by the rolls on the plate during the bending phase causes, by reaction, a deflection in opposite directions of the rolls themselves, which is greater in the middle of their length. In particular, the deflection of the rolls, besides by the working pressure, is caused by their slenderness coefficient given by the ratio between the diameter and the axial length of the same roll.

As the two working rolls of a bending machine, because of the reaction exerted by the plate, tend to deflect in opposite directions, spacing each other, this deflection causes a gradual widening of the contact points of the rolls with the plate, the gap of which increases toward the middle area of their length; therefore, as the rolls are more and more spaced from each other when approaching the middle area, this causes a not homogeneous pressure distribution on the iron sheet or plate while it is drawn by the two working rolls of the bending machine.

This changing of the space between the contact points of the rolls with the plate, causes in turn the formation of different bending diameters on the same plate: in practice, in the middle of the plate, because of the larger space between the contact points, greater diameters are obtained with respect to the ends, where the real bending diameters of the plate are close to the nominal bending diameter.

The plate instead of being deformed and bent with a perfectly cylindrical shape, presents a swelling shape, commonly said "barrel" or "cigar" shape, shown for example in FIG. 5; it can be clearly noted that the longitudinal slit between the opposed edges of the bent plate, is more open at the middle than at the ends.

In the attempt of overcoming such an inconvenience, to improve the use of these machines, it is usual for the manufacturers of roll bending machines to shape the rolls with a certain swelling degree or with tapering surfaces suitable to partially compensate their greater deflection at the middle during a bending operation. The upper and the lower rolls of the bending machine present therefore a cylindrical central portion, having a greater diameter, and tapering side parts having shapes and dimensions resulting from the features of the bending machine and the working to be executed; this is shown as example in FIG. 4 of the accompanying drawings.

This swelling shape of the working rolls in a roll-plate bending machine is therefore used to limit the defect of the "barrel" configuration of the iron sheet. However this defect increases when increasing the thickness of the plate; in an attempt to limit the same defect, sometimes it is necessary to reduce the working pressure of the rolls, resulting in a not always satisfactory quality.

The conicity of the gripping rolls causes in turn an opposite defect, which is revealed by a "reel" or saddle-like shape of the iron sheet, shown as example in FIG. 6; it can be noted how the longitudinal slit resulting in this case, is closer in the centre than at the ends.

This defect, which increases when decreasing the thickness of the plate, is particularly critical for thin plates; to attenuate the same, usually it is necessary to proceed in opposite direction to the previous one, by increasing the gripping pressure on the plate between the two working rolls.

Therefore, the manufacturers of bending machines are generally inclined to choose average values of the conicity of the gripping rolls, such to allow a compromise between the "barrel" defect for thick plates, and the "reel" defect for thin plates, consequently acting on the gripping pressure to carry out the necessary corrections.

All that involves therefore a greater constructional complexity for the rolls, a greater complexity in running the bending machine and a consequent limitation in the use of the bending machine itself; in practice, bending machines designed for bending thick plates are not suitable for bending thin plates and vice versa.

In an attempt of overcoming these inconveniences, according to what shown in the prior documents, it has been also proposed to adequately support the working rolls of the bending machine, in their longitudinal direction, by additional thrust rollers, or by a set of small support rollers suitably adjustable in the height. However this solution too gives rise to a great constructional complexity of the machine, high costs, and difficulties in producing tubular elements having a small diameter.

OBJECTS OF THE INVENTION

An object of the present invention is therefore to overcome the above mentioned drawbacks, in an extremely simple way, by providing a plate bending process and machine, able to produce roll-bent pieces having a substantially cylindrical shape, limiting the previously cited "barrel" or "reel" bending defects.

A further object of the invention is to provide for a plate bending machine which is suitable for use in a wide range of thickness for the plates to be bent, allowing a simpler and programmed control of the machine, or programmable by an operator.

The trend of the manufacturers of bending machines was therefore to use cylinders having a great diameter and a suitably swelling shape, in order to better resist to the deflection stresses, or to prevent the roll deflection by supporting the same rolls, for all their entire length, on the opposite side by supplementary rollers.

The present invention starts from a completely opposite principle: that is, instead of preventing the deflection of the working rolls of the bending machine, it takes advantage from their flexibility to compensate the traditional swelling defects. In this way, bent pieces having a substantial cylindrical shape are obtained thanks to a new bending process and a new bending machine which, from certain points of view, is innovative in its constructional features and in its functionality.

All of the above is obtainable by a bending process, or by a bending machine, wherein a deflection of both working rolls is caused in a same vertical direction, while an iron sheet is gripped between them, by exerting a thrusting action in a cross direction, acting on one or more points of one of the rolls, to cause their deflection in the same direction, allowing the two rolls to take a substantially parallel arched shape, having the same bending radius. In practice the lower roll, instead of deflecting in opposite direction with respect to the upper roll, increasing in this way the defect, is now allowed to deflect in the same direction till reaching a deflection substantially corresponding to the one of the upper roll.

In view of this new geometry of the bending machine rolls, the plate is gripped between the substantially parallel surfaces of the two rolls, allowing a greater regularity of the gap between the contact points, and a pressure homogeneity on the plate; it has been devised, from carried out tests, that in this way it has been possible to substantially eliminate or reduce the "barrel" or "reel" defects during the bending of a plate, by acting only with a thrust action on the rolls, uniquely or prevalently in one or more central areas of one of the rolls, leaving the other one free to deflect in the same direction, under the thrust action of the previous one.

BRIEF DESCRIPTION OF THE DRAWINGS

The invention will be better described hereinafter, with reference to a four-roll-bending machine, considering that the invention is advantageously applicable to any type of bending machines, provided with any number of working rolls. In the drawings.

DESCRIPTION OF THE INVENTION

With reference to figures from 1 to 3, we will now describe the general features of a roll plate-bending machine, of the four roll type, as well as a preferred embodiment of the thrust device for deflecting the rolls, according to the invention.

Figure 1:
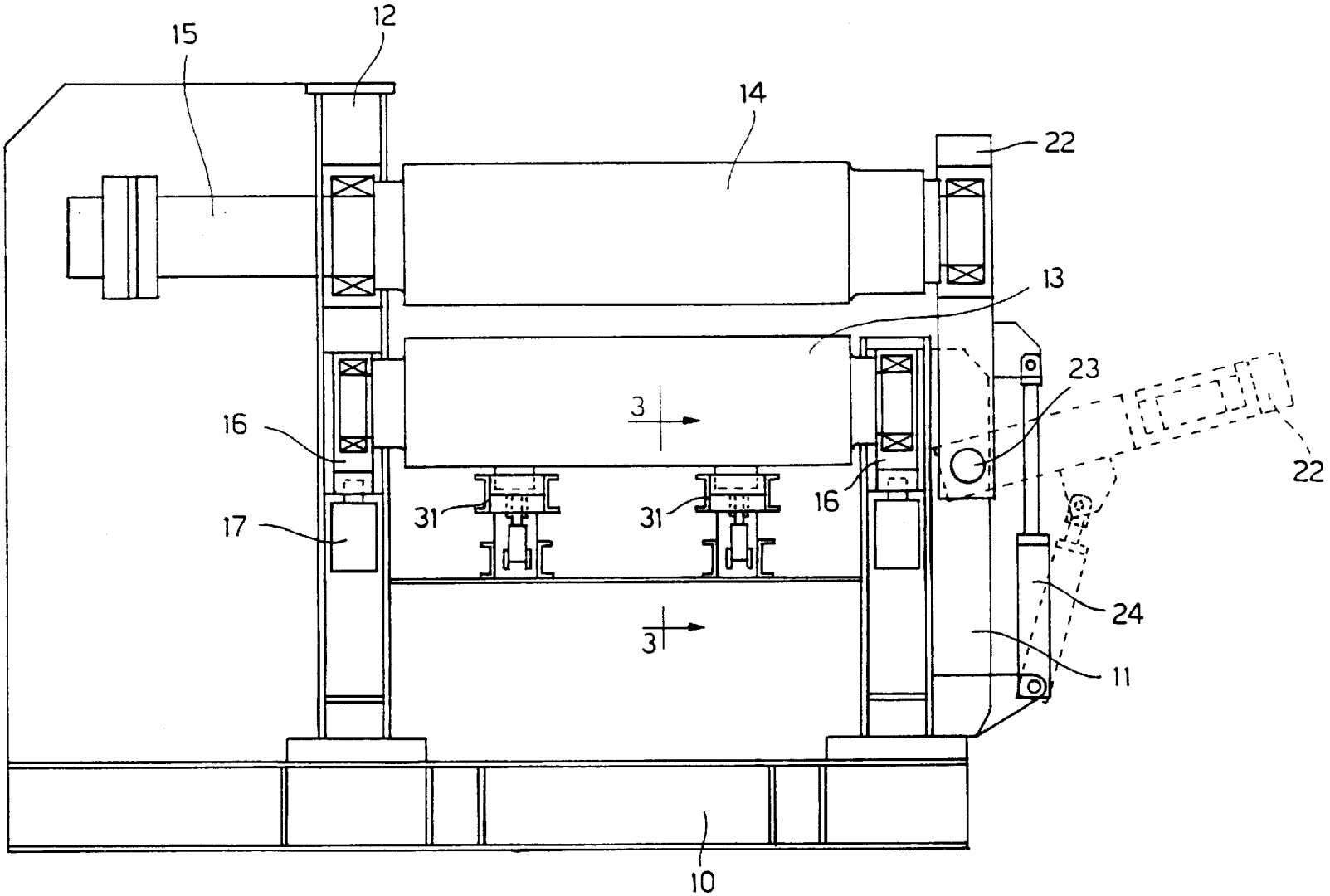
FIG. 1 is a side view of a bending machine.
Figure 2:
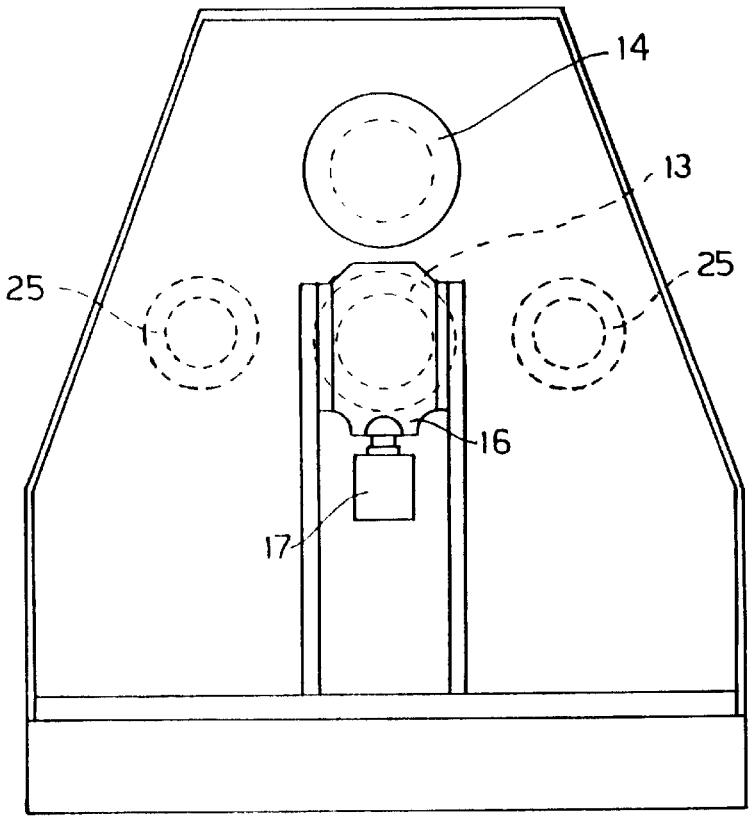
FIG. 2 is a view of the bending machine from the right end of FIG. 1.

A four roll bending machine, shown in FIGS. 1 and 2, substantially comprises a base frame 10, a front head 11 and a rear head 12 to support a lower working roll 13 and an upper working roll 14 parallely arranged with their horizontal axis, to define a gap in which an iron sheet to be bent is gripped.

One of the two working rolls, for example the upper roll 14, is rotatably supported at a fixed position in height, and it is connected to a geared motor 15 to drive its rotation; the upper roll 14 is supported at both ends only in such a way to freely flex upwardly due to the reaction force exerted by the iron sheet when gripped and rolled between the two rolls.

The lower working roll 13 on the contrary is movably supported on vertical guides, and is urged towards the upper roll 14 to provide for the necessary gripping pressure on an iron sheet disposed between the two working rolls. Therefore, the lower working roll 13, at each own end, is rotatably supported by a slide 16 moving along vertical guideways in the two heads 11 and 12 of the machine; the slides 16 may be driven to move upwardly till gripping an iron sheet disposed between the two rolls, by any lifting means, either of the hydraulic or mechanical type, in any case placed for example as schematically indicated by the reference number 17 in FIG. 1.

The upper roll 14, in correspondence of the front head 11, in its turn is supported by a pivotable arm 22, which may be laterally rotated downwardly, around a shaft 23 by a hydraulic drive cylinder 24, to disengage the front end of the upper roll when a bent plate is to be removed.

The four roll bending machine in the shown example, further comprises two side rolls 25, each one being supported to freely rotate by end supports which, in a known way, may slide or move in the direction of the upper roll 14.

According to the invention, the bending machine of FIG. 1 comprises deflection means for the upper and lower rolls 13, 14 comprising two hydraulic thrust devices 31, acting in intermediate positions, under the lower roll 13, for example at one third and two thirds of the length, to bend the lower roll 13 upwardly and toward the upper roll 14, exerting a strong thrust to grip the iron sheet L with the desired pressure, and at the same time to upwardly deflect both the rolls 13 and 14 in the same direction till reaching a substantially parallel arched configuration. By suitably acting with the thrusts exerted by the two hydraulic devices 31 generating the deflection, as described hereinafter, it is possible to adjust the negative downwardly deflection which the lower roll 13 would tend to have due to the reaction force of the iron sheet L, giving to the same lower roll 13 a positive upwardly bent deflection, substantially corresponding or conforming to the deflection of the upper roll 14.

A particular embodiment of a hydraulic thrust device 31 for generating the bending action of the two rolls 13, 14, and its operating way, is described hereinafter with reference to the example of FIG. 3 and to the subsequent figures of the accompanying drawings.

Figure 3:
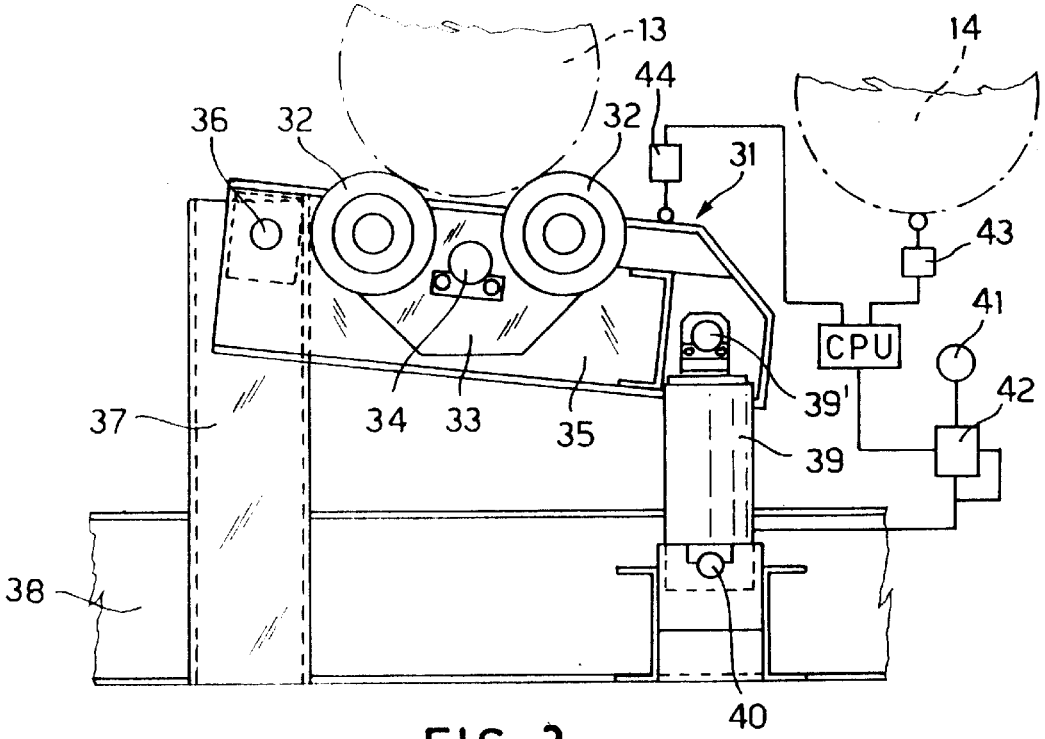
FIG. 3 is an enlarged view of a hydraulic device for generating the deflection of the rolls, according to line 3—3 of FIG. 1.

In the example of FIG. 3, the hydraulic thrust device for deflecting the rolls, substantially comprises a pair of small thrust rollers 32 which are positioned on the two sides, parallely and under the roll 13. The two thrust rollers 32 are supported to idly rotate, by a rocking support member 33, which is able to rotate around a pivot axis 34 provided in an intermediate position of a support arm 35. In particular, the pivot axis 34 of the support member 33 for the rollers 32, is disposed in correspondence or in close proximity of the vertical plane defined by the rotational axis of the two working rolls 13 and 14. One end of the support arm 35, in turn, is pivoted in 36 to an upright 37 fastened to a support structure 38 which extends transversally to the machine.

The other end of the support arm 35 is linked at 39' to the rod of a hydraulic cylinder 39 pivoted at 40 to the support structure 38.

The hydraulic control cylinder 39 of the deflection adjusting device, is connected to a fluid power source 41 through a pressure control valve 42, for example a maximum pressure valve, manually operable by an operator, or automatically in the way hereinafter described.

In case the adjustment of the roll deflection is to be carried out by an operator, he manually operates on the pressure control valve 42 to activate the two roll deflection devices 31, on the basis of sample information or reference data obtainable from a suitable table provided to the same operator, experimentally obtained depending on the thickness of the plates to be bent. Therefore, after the lower roll 13 has been risen to grip the plate against the upper roll 14, for example acting with the lifting devices 17, or preferably by the same roll bending devices 31 eliminating in this case the side lifting devices 17, the same operator acting the control valve 42, and reference data obtainable from the table provided for, will gradually increase the thrust of the cylinders 39 till reaching a prescribed pressure value, read in a suitable gauge, to which the required deflection of the rolls 13 and 14 will correspond, which will be suitable for that given thickness of plate to be bent. Once this pressure value has been reached together with the right bending of the rolls, the operator can start the machine to activate the bending operations of an iron sheet.

However, other solutions are possible which allow to automate the initial deflecting operation of the rolls 13 and 14, acting on the base of programmed data stored in a memory of an electronic unit for driving the machine, or being programmed by data obtained on line from suitable sensing means, as hereinafter explained.

In the first case, the CPU which controls the operation of the machine, comprises a permanent memory, programmed with a set of sample data or reference bends which, depending on the thickness of the plates to be bent, the roll deflection degree and possible functional parameters of the machine, automatically provides the system with data concerning the pressure values to drive a solenoid valve 41 to cause a rotation of the arm 35 for an angle proportional to the thrust required to generate the necessary deflection of the rolls 13, 14. It is also possible to operate by suitable sensing means 43 or 44 to reveal, on line, the deflection of the rolls 13, 14 directly or indirectly as shown in FIG. 3.

To this extent, as shown in the scheme of FIG. 3, the maximum pressure valve 42 is actuated by a process control unit CPU which at one end receives a deflection signal of the upper roll 14 through a deflection sensor 43, while on the other end receives a deflection signal of the lower roll 13 indirectly through a movement of the thrust device 31, for example of the supporting arm 35 for the rollers 32. In this case too, the rotation or the lifting movement of the arm 35, which is proportional to the deflection of the roll 13, is detected by a sensor 44, or by a signal generator connected to rotational axis 36 of the arm 35, said sensing means being connected to the data input of the control unit CPU.

The operation mode of the bending machine, and the process for bending plates according to the invention, will be now explained in greater detail with reference to figures from 4 to 9.

Figure 4:
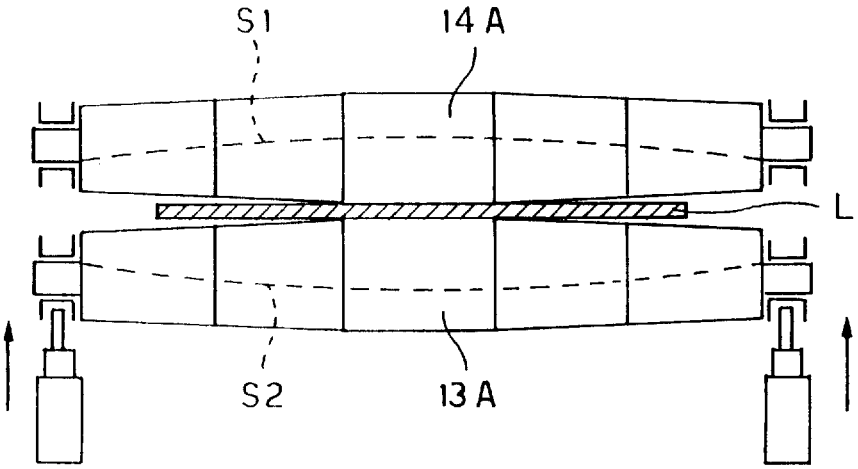
FIG. 4 shows the swelling shape of the rolls, according to the prior art.
Figure 5:
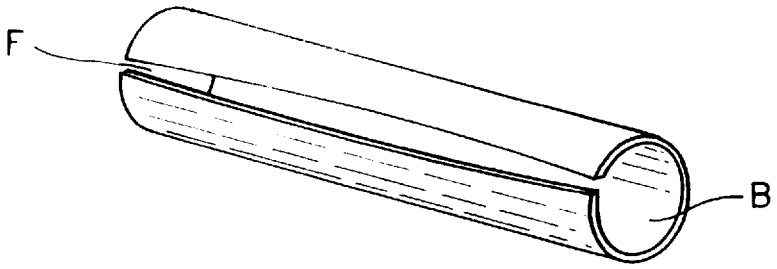
FIG. 5 shows the typical "barrel" configuration of a bent plate.
Figure 6:
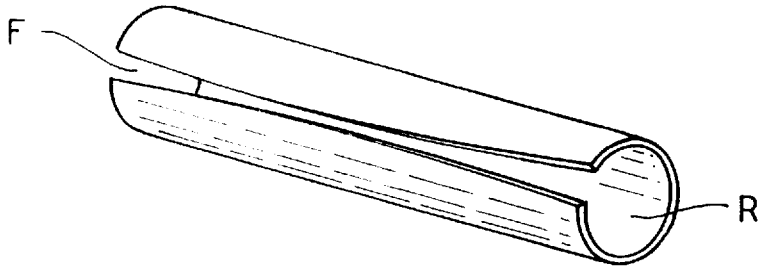
FIG. 6 shows the typical "reel" configuration of a bent plate.

FIG. 4 shows the configuration of the rolls 13A and 14A of a conventional bending machine while gripping an iron sheet L. From FIG. 4 it can be noted in particular that the reaction of the iron sheet L, would tend to bend upwardly the axis S1 of the upper roll 14A while would tend to deflect downwardly the axis S2 of the lower roll 13A in the opposite direction with respect to the previous one. The opposite deflection of the two rolls would cause a progressive spacing of their contact points with the plate L; consequently a barrel defect will be caused in the rolled piece B evidenced by a longitudinal slit F diverging in the middle portion in the case of thick plates, in FIG. 5, or a reel configuration in the case of thin plates, as shown in the example of FIG. 6.

Figure 7:
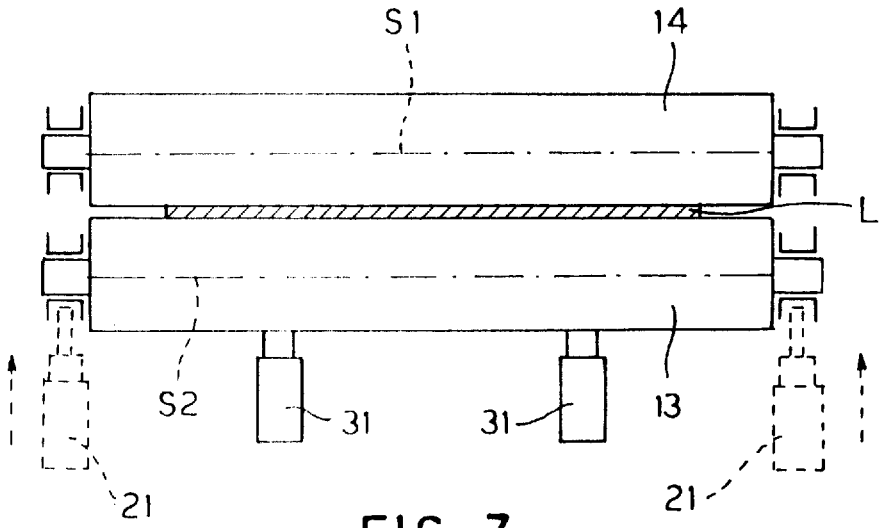
FIG. 7 schematically shows the rectilinear configuration of the working rolls of the bending machine of FIG. 1, before starting a bending operation, without any thrust acting on the rolls.

On the contrary, according to the invention, as shown in FIG. 7, the rolls 13, 14 may in this case have a perfectly cylindrical, or slightly swelling configuration, but remarkably lower than the traditional rolls, with their axes S1 and S2 substantially rectilinear and parallelly arranged at the beginning of each working step. At the beginning of each working step, the lower roll 13 is in the lowered condition of FIG. 1, to allow the introduction of an iron sheet L, then the lower roll 13 is risen till to bring the sheet L in contact with the upper roll 14, as shown in FIG. 7. At the end of the rising phase, the sheet L results therefore gripped in the nip between the two rolls 13 and 14, with a light pressure, so that the same rolls still present a rectilinear and parallel configuration.

As previously referred, according to a preferential embodiment of the invention, the lifting means for the lower roll 13 are constituted by the same thrust and deflecting devices 31, in substitution of the side lifting member 17, which in this case can be eliminated. This solution is suitable for a wide range of thickness of plates, resulting particularly suitable for plates of medium and large thickness. For thin plates, in some cases it is possible to forecast the use of side lifting means 17, in combination with the thrust devices 31, to lift the lower roll 13 and to adjust possible bending defects of the rolled plates.

Figure 8:
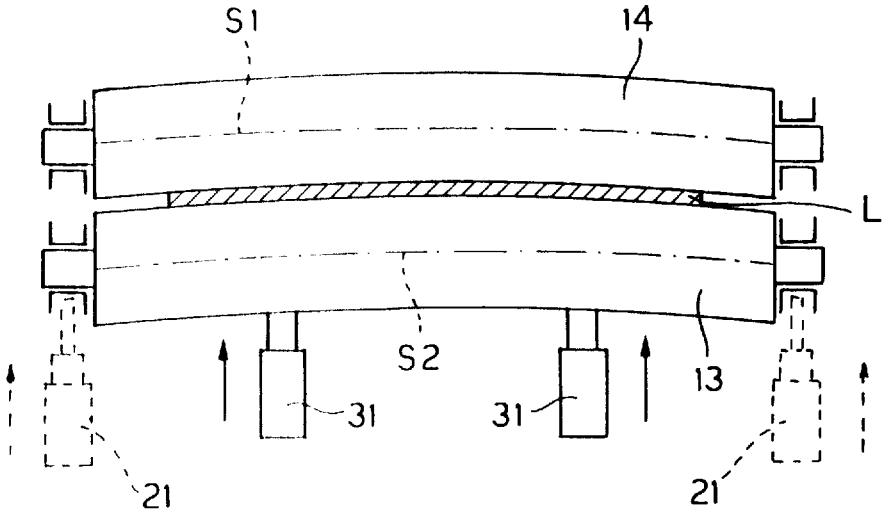
FIG. 8 shows the arched configuration of the rolls of FIG. 7 during a bending operation.

As soon as the plate L to be bent is pressed against the upper roll 14 by the thrust exerted by the lower roll 13, the upper roll 14 being supported only at its two ends, deflects upwardly taking the curve indicated by the axis S1 in FIG. 8. The lower roll 13, in a traditional bending machine would tend to bend downwardly in conformity with the example of FIG. 4. However, according to the invention, the two thrust generating devices 31, as shown in FIG. 8, act to deflect the lower roll 13 upwardly, against the upper roll 14, in such a way that the same roll 13 takes on in its turn an arched configuration represented by the axis S2 conforming to the configuration similar or substantially parallel to the one of the upper roll 14. In this way it is possible to maintain a substantially homogeneous distribution of the gripping pressure acting on the plate for all the length of the sheet L. Once the two rolls 13, 14 have undergone a substantially similar deflection, the machine may be started and the iron sheet bent maintaining the thrust of the lower roll and the deflection of both the rolls.

In the case of a manual control of the maximum pressure valve 42, the operator will take care that the pressure of the oil fed to the cylinder 39, gradually increases till reaching a pressure value given by a suitable reference table. On the contrary, in case of an automatic control through preprogrammed data in the CPU or provided with the deflection sensors 43 or 44, the thrust on the lower roll 13 and the upwardly deflection of the two rolls 13, 14 will continue till reaching the deflection degree programmed or detected by the sensing means 32 and 43.

Figure 9:
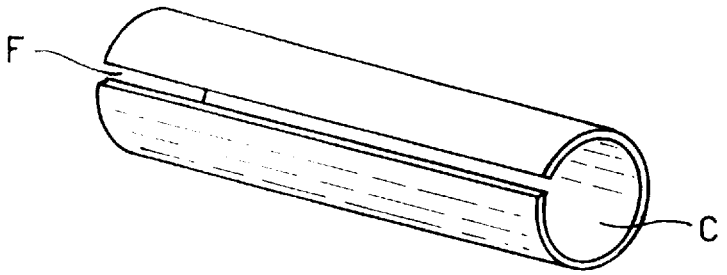
FIG. 9 shows the cylindrical shape of a piece bent by the bending machine of FIG. 1.

In all cases, as clearly resulting from FIG. 8, the surfaces of both the rolls 13, 14 which are in contact with the plate L, will remain at constant space for the entire width of the plate L, which therefore could be wound in a perfectly cylindrical shape, maintaining the edges of the slit F perfectly parallel and close, as shown in the example of FIG. 9.

As previously stated, the hydraulic deflection device 31 for the rolls 13, 14, according to the present invention, allows for keeping the arched profiles of the two rolls substantially identical or parallel to each other, and for controlling said deflection by adjusting the upwardly oriented thrust acting on the lower roll, in the same direction where the upper roll usually deflects. It is possible in this way to operate with rolls having a cylindrical shape; however in some cases, in combination with the hydraulic deflection device, it is also possible to use slightly swelled rolls, in order to obtain better results; moreover, in substitution of the device 31 of FIG. 3, wherein the opposite rollers 32 are supported by a pivoted arm 35, rolls 32 could be supported by a vertically sliding support member, for example by a slide or directly by the piston of a hydraulic cylinder vertically arranged, the axis of which is resting on a plane passing through the rotational axis of the rolls 13 and 14.

From the above disclosure, it will be clear therefore that it has been provided a process for bending plates, and a bending machine, operating with totally novel criteria, on the base of a principle which has no other comparison, but indeed operates in a direction completely opposite to the trends followed till now on traditional bending machines. It is intended however that what is stated and shown with reference to the accompanying drawings, has been given only for explaining the general principles of the invention, illustrating a preferred embodiment, without being a limitation.

What is claimed is:

1. In a process for bending plates, wherein an iron sheet to be bent is made to pass between an upper gripping roll and a lower gripping roll parallely arranged between each other, at least one of these rolls being connected to a drive motor for rotation, and in which one of the rolls is movably supported towards the other roll to exert a required working pressure on the plate to be bent, the improvement comprising the steps of:

allowing a free deflection of one of the rolls, and exerting a thrust action on the other one of the rolls, in a cross direction and towards said one roll;

causing a deflection of both rolls in which the lower roll takes an arched configuration substantially parallel to the upper roll;

detecting the deflection of at least one of the gripping rolls;

controlling the deflection of the other one of the gripping rolls depending on the deflection of said one roll; and carrying out a bending operation of the iron sheet by rotation of said upper and lower rolls, while maintaining their deflection.

2. The process according to claim 1, wherein the thrust and deflection action are exerted, in at least one intermediate point of the lower roll.

3. The process according to claim 1, wherein a control unit is programmed with reference data relating to the different bending degrees of the upper and lower rolls depending on the thickness of the plates to be bent, and the thrust action is exerted to cause a flexion of both rolls until a bending degree is reached corresponding to a given reference selected value of the bending degrees between those stored and programmed in the control unit.

4. The process according to claim 1, wherein the deflection of the gripping rolls is carried out by at least one manually operable thrust member in which the deflection of the gripping rolls is caused by manually controlling the thrust member on the base of reference data obtained from a table depending on the thickness of the plates to be bent.

5. The process according to claim 1, wherein the thrust on said gripping rolls is maintained at a prefixed constant value, during bending of the iron sheet.

6. In a machine for bending plates comprising an upper gripping roll and a lower gripping roll, parallely arranged between each other and rotatably supported to rotate on their horizontal axis, at least one of the two gripping rolls being connected to a drive motor for rotation, and one of the gripping rolls being movably supported towards the other one to exert a working pressure on the plate to be bent, the improvement wherein the machine further comprises:

thrust means for causing deflection of the gripping rolls;

control means for controlling the deflection of said rolls;

said thrust means comprising at least one adjustable thrust member in an intermediate position on one of the gripping rolls to cause a deflection of both gripping rolls, in a same direction;

said thrust means comprising a hydraulic cylinder connectable to a fluid power source through a pressure control valve operatively connected to an electronic control unit;

first sensing means for detecting the deflection of one of the gripping rolls; and second sensing means for detecting the deflection of the other one of said gripping rolls;

said first and second sensing means being operatively connected to said control unit.

7. The machine according to claim 6, wherein the movable gripping roll is supported by lifting means.

8. The machine according to claim 6, wherein the thrust means comprise at least a first and a second hydraulic thrust device in intermediate and axially spaced apart positions from the ends of both rolls.

9. The machine according to claim 6, wherein said thrust means comprise at least a first and a second idly rotating thrust rollers spaced apart and parallely arranged to contact the lower gripping roll of the machine, said rollers being pivotally supported by a rocking member to rotate on an axis parallely arranged to the axes of the gripping rolls; said rocking member being pivoted to a support member movable in a vertical plane; and drive means structured and arranged to move said support member, the rocking member and the rollers, towards the gripping rolls of the bending machine.

10. The machine according to claim 9, wherein the rocking member supporting said thrust rollers is provided on a pivoted arm linked to a hydraulic cylinder.

11. The machine according to claim 6, wherein said pressure control valve is a manually operable maximum pressure control valve.

12. The machine according to claim 9, wherein the first sensing means directly detect the deflection of the upper gripping roll, and the second sensing means indirectly detect the deflection of the lower gripping roll by a displacement of the support member for the thrust rollers acting on the same gripping roll.

13. The machine according to claim 6, wherein the electronic control unit comprises a memory programmed with reference data concerning roll deflection values, depending on the thickness of the plates to be bent.

14. The machine according to claim 6, wherein the bending machine includes two rolls.

15. The machine according to claim 6, wherein the bending machine includes three rolls.

16. The machine according to claim 6, wherein the bending machine includes four rolls.

* * * * *